US005883394A

United States Patent [19]

Mussman

[11] Patent Number: 5,883,394

[45] Date of Patent: Mar. 16, 1999

[54] RADIATION SHIELDS

[76] Inventor: Robert L. Mussman, P.O. Box 2805, Bremerton, Wash. 98310

[21] Appl. No.: 761,596

[22] Filed: Dec. 6, 1996

Related U.S. Application Data

[60] Provisional application No. 60/008,357, Dec. 7, 1995.

[51] Int. Cl. [6] ..... G21F 1/12

[52] U.S. Cl. ..... 250/515.1; 250/517.1; 250/519.1

[58] Field of Search ..... 250/515.1, 517.1, 250/519.1; 16/87 R

[56] References Cited

U.S. PATENT DOCUMENTS

| | | | |
|---|---|---|---|
| 855,352 | 5/1907 | Smith | 16/87 R |
| 1,844,512 | 2/1932 | Mains . | |
| 1,854,942 | 4/1932 | Lapof | 250/517.1 |
| 2,858,451 | 10/1958 | Silversher | 250/515.1 |
| 2,928,948 | 3/1960 | Silversher | 250/515.1 |
| 3,134,020 | 5/1964 | Shoenfeld | 250/108 |
| 3,197,379 | 7/1965 | Alfille et al. | 176/43 |
| 3,340,047 | 9/1967 | Persson et al. | 75/126 |
| 3,785,925 | 1/1974 | Jones | 250/506.1 |
| 3,801,448 | 4/1974 | Brandstetter et al. | 176/40 |
| 3,984,695 | 10/1976 | Collica et al. | 250/515.1 |
| 4,027,377 | 6/1977 | Roszler | 29/420.5 |
| 4,381,282 | 4/1983 | Elter et al. | 376/292 |
| 4,948,981 | 8/1990 | Wallace et al. | 250/517.1 |
| 5,139,857 | 8/1992 | Herndon et al. | 428/220 |
| 5,379,332 | 1/1995 | Jacobson | 250/519.1 |

OTHER PUBLICATIONS

Power Engineering, "Coated Lead Shielding Protects Nuclear Plant Workers," Sep., 1996.

*Primary Examiner*—Jack I. Berman
*Attorney, Agent, or Firm*—R. Reams Goodloe, Jr.

[57] ABSTRACT

A radiation shield, and a radiation shield assembly. The shield assembly is designed to allow use of conveniently fabricated radiation shield portions to provide a single completed radiation shield. The shield portions are mechanically fastened together, preferably with deck screws. A completed radiation shield assembly is coated with a flexible elastomeric epoxy coating to protect the radiation shielding material, preferably lead, from becoming dislodged. Preferably, the radiation shield is provided in a sequence of layers, with each layer having one or more radiation shield portions. In an alternate embodiment a lightweight, portable radiation shield is provided which has an inner layer with at least one sheet of solid radiation shielding material, an outer stainless steel casing, and a sealant located between at least portions of the at least one sheet of solid radiation shielding material and the outer stainless steel casing. Flanges on the stainless steel casing are fastened together, preferably by riveting to seal the casing. A stainless steel U-shaped cap is provided at the top of the shield for extra protection during use. The sealant and the stainless steel casing, including the cap, cooperate to effectively seal the solid radiation shielding material against leakage outward through the outer stainless steel casing.

30 Claims, 6 Drawing Sheets

$D_P O$
$D_1 O$
$D_2 O$
$D_2 I$
$D_1 I$
$S_1$
$S_2$
$S_1(1)$
$S_2(1)$
$S_1(2)$
$S_2(2)$
$S_1(3)$
$S_2(3)$
C
E
12
14
10
20
2
L
W
T
S
26
14'

RADIATION SHIELDS

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

This application claims priority from U.S. Provisional Application Ser. No. 60/008,357, filed Dec. 07, 1995, the disclosure of which is incorporated herein by this reference.

TECHNICAL FIELD OF THE INVENTION

This invention relates to novel, improved devices for radiation shielding, and to methods for fabricating and using the same. Devices of that character are well suited for use in protecting personnel from ionizing radiation in nuclear power plants, and in particular in protecting personnel from receiving doses of ionizing radiation which are emitted from structures such as pipe and valves.

BACKGROUND OF THE INVENTION

A continuing demand exists for a simple, inexpensive radiation shield which can be used to simplify the installation and/or removal of shielding material as may be necessary to achieve reductions in dose exposure to personnel in nuclear power operations, particularly as regards exposure to gamma radiation. This is true today, even though flexible lead shielding, or encased lead shielding has heretofore been widely used for providing certain types of radiation shielding. In fact, in older nuclear power plants, the dose exposures to plant workers due to accumulations of radioactive materials in plant structures, and in particular, pipe runs, increasingly have brought this problem to the attention of plant operational personnel. During maintenance and overhaul of power plant systems, personnel are frequently required to perform operations that bring them into close proximity to locations which have the potential to accumulate, and thus emit, potentially harmful ionizing radiation.

Generally, the prior art apparatus and methods known to me are too cumbersome, and they are not particularly well adapted to being secured in place for long term radiation protection. As a result, the overall radiation dosage received by nuclear plant workers could be appreciably reduced with the availability of improved radiation shielding devices, and in particular, with improved devices that are suitable for being left in place for continued use during long term plant operations.

It would also be desirable for a number of reasons to be able to utilize multiple radiation shield portions in a radiation shield application. First, multiple shield portions could be used to increase the shielding effect, by combining the shielding capability of multiple layers of radiation shield portions. Second, multiple shield portions could be utilized to efficiently accommodate a varying dimensional requirement, such as the curve of a pipe, or an elbow in a pipe run. Third, many fabrication personnel find that it would be desirable to have radiation shield portions which can be conveniently fastened together to produce a final radiation shield of a desired size, in an easy, building block fashion.

One important problem which must also be overcome with respect to any lead based radiation shield design is the potential for contamination of lead by existing radioactively contaminated materials, as that would result in further contamination since the lead may itself become radioactive. In other words, the use of a lead shield necessitates protection of such a lead shield, to avoid the possibility of further contamination, of either the lead itself, or of the underlying area due to lead becoming deposited thereon. This problem is further aggravated when the shields are placed in locations subject to high temperature or to water spray. Depending upon the anticipated service, a radiation shield may be subject to various adverse or harsh operating conditions, and thus the design must accordingly be capable of reliably protecting the lead during such service.

Currently, when it becomes necessary to work on or near pipe runs which are emitting an appreciable radiation dosage, common practice has been to use a type of wool blanket, or lead shot bags, or lead strips. Each of such apparatus and the methods for their use are somewhat effective in reducing radiation dosage, but in each case, their use has certain drawbacks, including:

(1) the equipment is too bulky (especially in the case of a lead wool blanket);

(2) the equipment is prone to leak (such as in the case of lead shot bags, where loss of lead causes other contamination problems); and (3) installation of the apparatus is too time consuming (such as in the case of installation of lead sheet strips).

Although at least one proprietor has recognized the need for an improved radiation shielding that is available in sizes that can be manipulated by hand by a single workman, and which protects the underlying structure from lead contamination, unfortunately, such devices known to me have left something to be desired. Consequently, I have developed novel radiation shielding designs, and methods for their fabrication, and for their installation, which provide radiation shielding which is superior to earlier radiation shielding apparatus and techniques which are known to me.

Radiation shielding devices which provide some of the general capabilities desired have heretofore been proposed. Those of which I am aware include those described in the following patents: U.S. Pat. No. 5,012,114 issued to Sisson on Apr. 30, 1991 for a Radiation Shield; and U.S. Pat. No. 3,785,925 issued to Jones on Jan. 15, 1974 for a Portable Radiation Shield for Nuclear Reactor Installation.

The patent documents identified in the preceding paragraph disclose devices which do not provide permanently affixable radiation shield designs, and thus are inherently not as well suited, as disclosed, for many of the applications which are of interest to me. The radiation shielding devices provided by Sisson are not suitable for exposure to moderate or high temperatures, or to water spray environments, due to use of a vinyl plastic sheet as a protective surface material. And, the portable shield provided by Jones, which is designed for protection of the dry well during removal of fuel from a BWR plant, though it involves the provision of a lead filled stainless steel shielding device, is so large and unique as to be inapplicable for most of the smaller applications of interest to me. Therefore, there still remains an unmet and increasingly important need in the field for a radiation shield which is designed and manufactured in a way that assures sufficient structural strength to withstand use for either permanent or temporary service in harsh conditions, and which have the assurance that retrieval is possible without encountering adverse lead contamination. Thus, the advantages offered by my novel radiation shield designs, which are permanently mountable (even in highly controlled locations such as a dry well) and which may be provided in sizes which are transportable by a single worker, yet be removable and cleanable, are important and self-evident.

SUMMARY OF THE INVENTION

I have now invented, and disclose herein, a novel, radiation shield for use in attenuating exposures of radiation workers to ionizing radiation. Unlike radiation shields heretofore available, my shields are simple to build, particularly for custom applications, easy to install, relatively inexpensive, easy to use while avoiding undesirable lead contamination, and are otherwise superior to the heretofore used or proposed radiation shield devices of which I am aware.

In one exemplary embodiment my radiation shield is provided in a sequence of layers of radiation shield portions, wherein the sequence of layers of radiation shield portions comprises a first shield layer $S_1$ through an Nth shield layer $S_N$, wherein N is an integral number corresponding to the number of radiation shield layers provided. In each of the shield layers $S_1$ through $S_N$, a one or more, and preferably a plurality shield portions is provided. The number of shield portions in each layer may be described, in sequence, as shield portions $S_1(1)$ through $S_1(X)$ occurring in a first shield layer, through shield portions $S_N(1)$ through $S_N(X)$ in the Nth shield layer. For each layer, a positive integer X, one or larger, describes the number of shield portions in that layer.

In one embodiment, my radiation shields are provided with flexible, elastomeric coating, with a minimum of 60 percent elongation, and a Shore D hardness of about 37, and with a tensile sheer strength of approximately 347 pounds per square inch. The coating is preferably provided in a Bisphenol A epoxy which is cross-linked with a modified cycloaliphatic amine curing agent. Grommets are provided for ease of hanging the shields. The shields can be provided in the shape of a segmented annulus, up to half-round form, or in planar sheet form.

In another embodiment, my shields are provided with an inner layer of at least one sheet of solid radiation shielding material, and an outer stainless steel casing. A sealant, preferably silicon sealer type, is used between at least portions of the solid radiation shielding material and the outer stainless steel casing. The sealant and the stainless steel casing cooperate to effectively seal the solid radiation shielding material against leakage outward through the outer stainless steel casing.

My novel radiation shields are simple, durable, and relatively inexpensive to manufacture. In use, they provide a significant measure of reduction in radiation exposure to workers, by virtue of their ease of use in areas which were heretofore difficult to shield, and thus provide a significant improvement a radiation shield device.

OBJECTS, ADVANTAGES, AND FEATURES OF THE INVENTION

From the foregoing, it will be apparent to the reader that one important and primary object of the present invention resides in the provision of novel radiation shield devices which can be custom fabricated to fit the particular needs of a given application, in order to minimize installation difficulties while maximizing the effective dosage exposure reductions ultimately achieved.

Other important but more specific objects of the invention reside in the provision of custom built, coated (e.g., painted) sheet lead shielding materials which:

- can be used in radioactively contaminated areas with minimal risk of contamination by the lead from the shield;
- can be provided in a simple coating that allows use in moderately moist environments;
- can be used where the shielding is not expected to encounter high temperatures;
- can be used where the shielding is not expected to encounter high pressure water spray;
- which can be used in direct contact with stainless steel piping and components;
- are relatively simple, particularly in the manufacture and installation, to thereby enable the devices to be easily prefabricated and installed for unique applications; and
- which can be easily decontaminated.

My radiation shields are also advantageously provided in specially designed and fabricated encapsulated (e.g, stainless steel) sheet lead materials which have additional important and more specific objectives, in that they:

- can be easily used with stainless steel plate as the encapsulating material, so as to allow use in areas which may encounter high pressure spray;
- can be used in radioactively contaminated areas with an absolute minimum of risk of contaminating the lead in the shield;
- can be used on or around piping and components requiring that the shielding be protected against moisture, heat, and high temperature water or steam;
- can be left inside the primary containment building during operation of the nuclear reactor plant.

Coated radiation shields fabricated as described herein can be custom built, and specially designed and fabricated, and which are:

- compatible with direct stainless steel contact;
- easy to decontaminate;
- able to withstand short duration exposure to water or spray;
- able to withstand short duration moist temperatures to about 145° F.; and
- are able to withstand moderate flexing and bending, without cracking and peeling.

Stainless steel encapsulated lead shields fabricated as described herein can be custom build, and specially design and fabricated, and which are:

- compatible with use in moderately high temperature environments (up to 450° to 500° F.);
- able to withstand prolonged exposure to moisture and high pressure water or steam spray;
- are able to withstand moderate flexing and bending;
- easy to install and to remove.

Other important objects, features, and additional advantages of my invention will become apparent to the reader from the foregoing and from the appended claims and as the ensuing detailed description and discussion proceeds in conjunction with the accompanying drawing.

BRIEF DESCRIPTION OF THE DRAWING

In the drawing.

In the various figures of the drawing, identical features will be indicated with the same reference numerals, and similar features in alternate embodiments or locations may be indicated with use of prime (') superscripts, without further mention thereof.

DETAILED DESCRIPTION OP THE INVENTION

Figures 1, 1A, 1B:
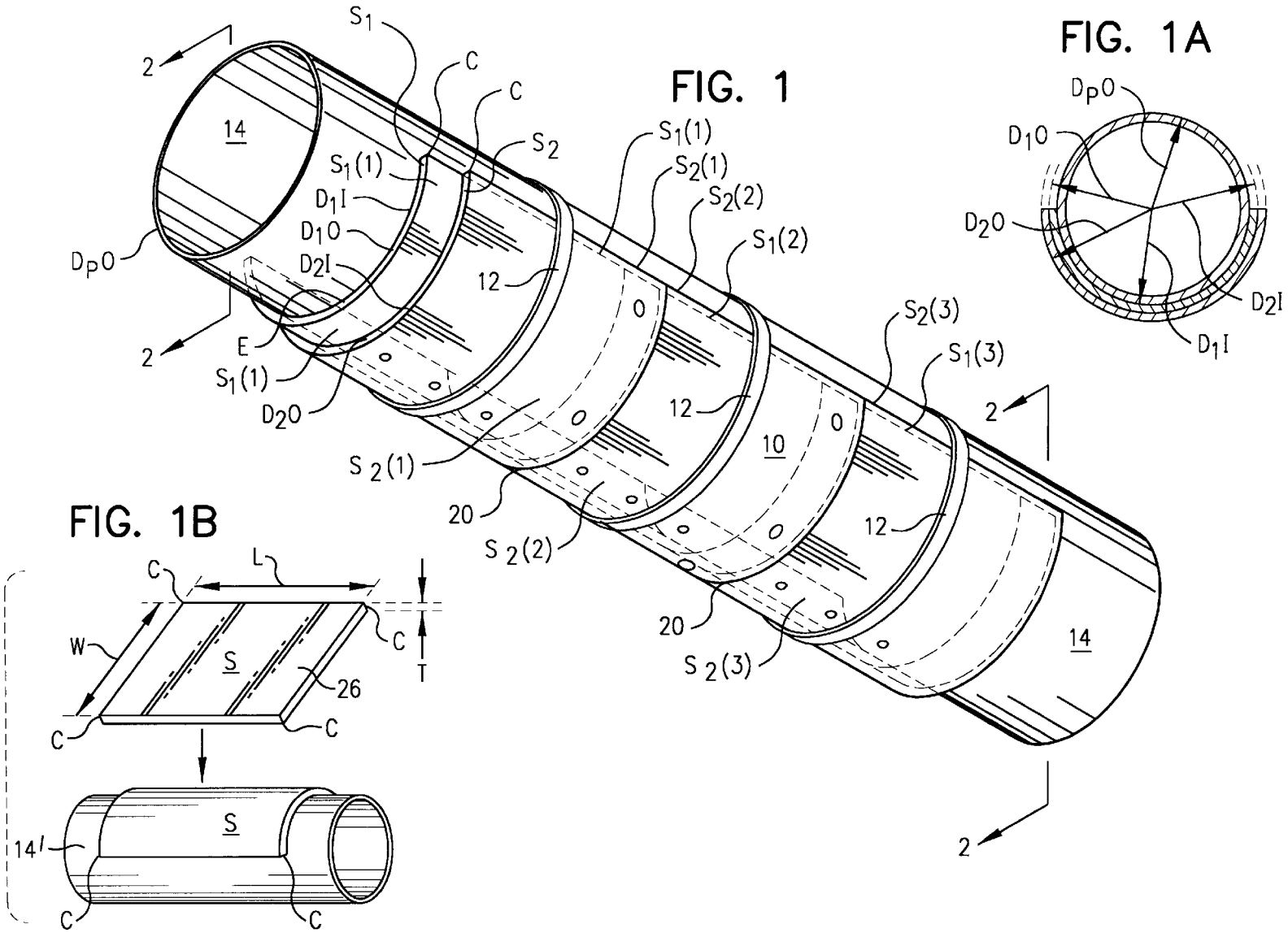
FIG. 1 is a perspective view of my radiation shields shown in place on the underside of a length of pipe, showing the use of a two layer shield, with the final radiation shield made up of one set of shield portions of a desired thickness which are overlaid by another set of shield portions of a desired thickness.
FIG. 1A is a vertical cross sectional view of a pipe section with a two layer radiation shield thereon, showing the diameters of various parts.
FIG. 1B is a schematic depiction of a method of fabricating half-round shield portions.
Figure 2:
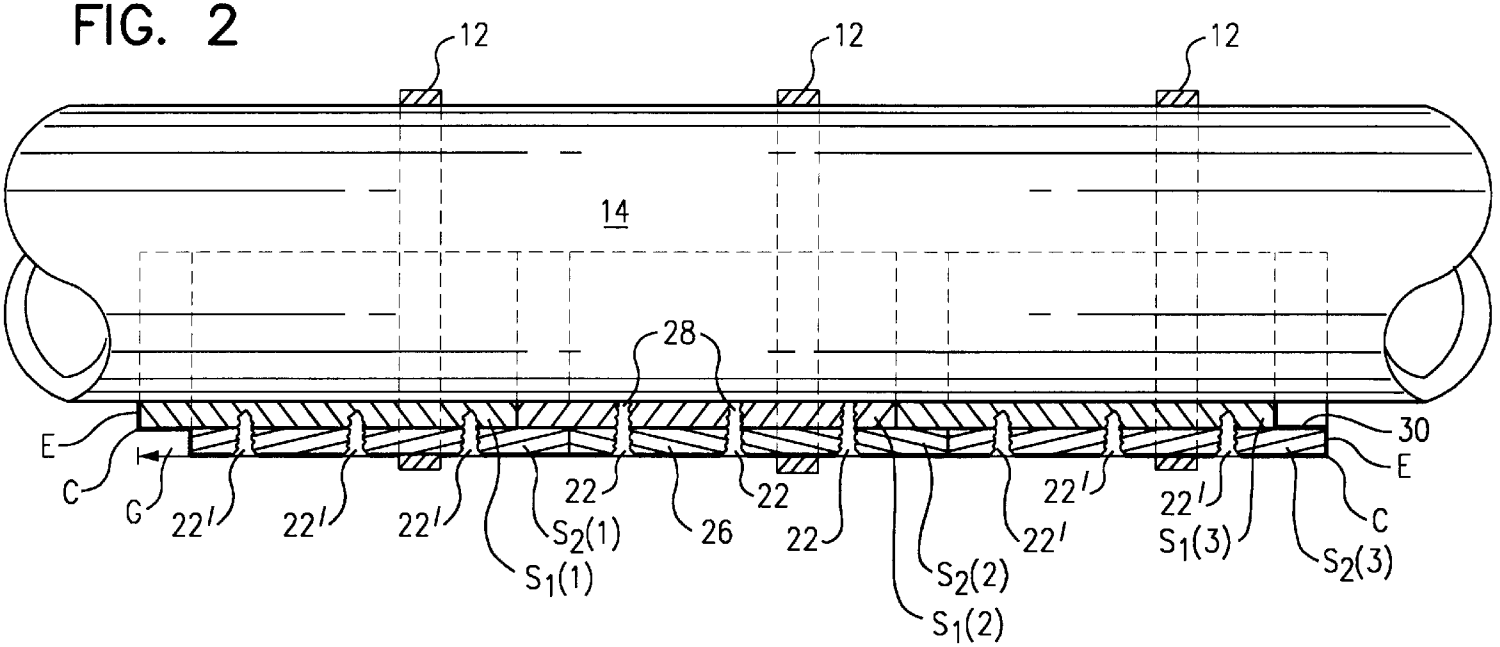
FIG. 2 is a partial vertical cross-sectional view of the radiation shield just set forth in FIG. 1, with the radiation shield portions shown in cross-section taken as if looking rearward at a vertical cross-section along the pipe length shown in FIG. 1; however, a side view of the pipe to which the radiation shield is attached is provided, for clarifying the method of installation.

Referring now to the drawing, FIG. 1 depicts, in a vertical position, a radiation shield 10 fabricated according to my design, affixed in place by steel bands 12 about a section of pipe 14. As illustrated, a first layer $S_1$ of shield portions is provided; these are identified as shield portions $S_1(1)$, $S_1(2)$, and $S_1(3)$. A second layer $S_2$ of shield portions is provided; these shield portions are identified as shield portions $S_2(1)$, $S_2(2)$, and $S_2$ (3). Thus, it can be seen that the radiation shield 10 can be fabricated using a sequence of radiation shield portions that are provided in one or more layers. When a plurality of layers $S_1$, through $S_N$ are provided, N is a positive integral number corresponding to the number of layers provided. In each of the layers $S_1$ through $S_N$, one or more shield portions may be provided. In each such layer $S_N$, shield portions may be described by a sequence of shield portions $S_N(1)$ through $S_N(X)$, where X is a positive integer representing the number of shield portions in that layer.

As is intuitively obvious in view of the specific example set forth, and by use of the various figures of the drawing, the location of any one radiation shield layer $S_N$ may generally be described relative to other shield layers therebelow, such as $S_{N-1}$ for the shielding layer immediately below layer $S_N$, or relative to other layers thereabove, such as layer $S_{N+1}$ for the layer immediately above layer $S_N$.

I prefer to fabricate each radiation shield 10 before attachment to pipe 14. As can be seen in FIG. 1A, when my radiation shields are used on a pipe 14, shield portions $S_1(1)$, etc., must be fabricated so that the inner diameter $D_1I$ substantially conforms to the outer diameter $D_PO$ of pipe 14. Then, the inner diameter $D_2I$ of shield portions (e.g., $S_2(1)$) which are used in the second layer $S_2$ must substantially conform to the outer diameter $D_1O$ of the shield portions (e.g., $S_1(1)$) which are used in the first layer $S_1$ of the shield portions. As is evident from FIG. 1A, each of the radiation shield portions is provided in the shape of a segment of an annulus.

For convenience in fabrication, I have prepared a table which eliminates the need to calculate diameter dimensional data for commonly encountered pipe sizes. In Table I below, I have provided the size and weight encountered for a first layer $S_1$, shield portion and for a second layer $S_2$ shield portion, when the radiation shield making up each layer is fabricated from a sheet

TABLE 1

LEAD CUT SIZES FOR FABRICATION OF HALF-ROUND SHIELDS

| Pipe size (in.) | Pipe Outside Diameter $D_pO$ | Width - W for ¼" (inner piece) $S_1$ layer) | Width - W for ½" (outer piece-) $S_2$ layer) | Weight ¼" × 12" pounds | Weight ½" × 12 pounds |
|---|---|---|---|---|---|
| 1 | 1.365 | 2½ | 2⅞ | 3⅛ | 6¾ |
| 2 | 2.375 | 4⅛ | 5 | 5⅛+ | 11⅜+ |
| 3 | 3.5 | 5⅞ | 6¾ | 7⅜ | 15½ |
| 4 | 4.5 | 7½ | 8¼ | 9⅜ | 19¾ |
| 5 | 5.563 | 9⅛ | 9⅞ | 11⅜ | 23¾ |
| 6 | 6.625 | 10¾ | 12 | 13⅜ | 27⅞ |
| 8 | 8.625 | 13½ | 15 | 16⅞ | 35½ |
| 10 | 10.75 | 17¼ | 18½ | 21½+ | 45 |
| 12 | 12.75 | 20¾ | 22 | 26 | 53½ |

NOTE:
This table assumes 1/4 (0.25) inch lead sheet stock is used.

of lead S of thickness T, and where the thickness T is selected at ¼ (0.25) inches. As indicated in FIG. 1B, my preferred method of fabricating a half-round coated lead shield, such as any of the shield portions shown in FIG. 1, is to first determine the pipe size of pipe 14, and then cut a flat lead sheet S of 0.25 inches thickness T into the width W indicated according to Table 1, and in a desired length L. Then, using a pipe mold 14', the flat lead sheet is molded to fit the pipe 14 size. When a final radiation shield 10 is to be made in two 0.25 inch layers, the inner layer $S_1$ is first made, and then the second layer $S_2$ is preferably shaped over the piece for the first layer $S_1$. For ease in fabrication, I prefer to leave an offset gap G of about one (1) inch, to offset, layerwise, the gap between adjacent shield portions (e.g., $S_1$(1) to $S_1$(2) and $S_2$(1) and $S_2$(2). Space 20 between adjacent shield portions should be minimized in order to avoid loss of shielding effectiveness.

Figure 3:
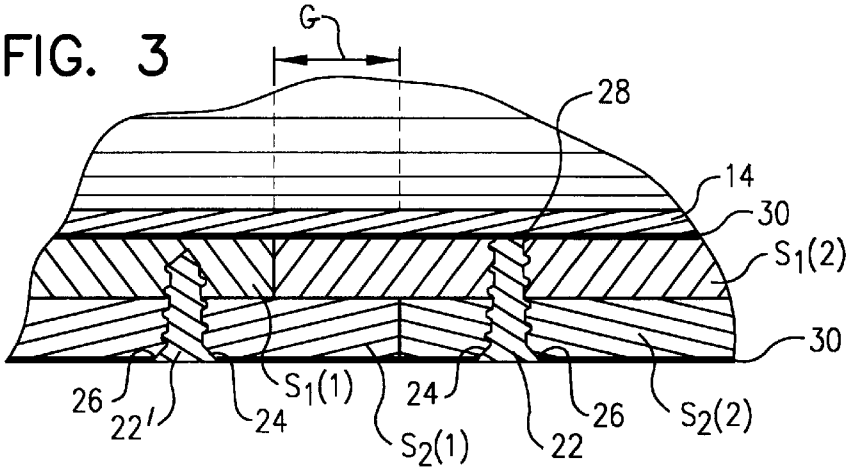
FIG. 3 is vertical cross-sectional view, similar to the view just illustrated in FIG. 2, but now showing full cross-sectional detail of the pipe on which the radiation shield is affixed.

To assemble shield portions into a final radiation shield 10, for example when fabricating a final radiation shield 10 of ½ (0.5) inch thickness (using one quarter inch lead in each of layers $S_1$ and $S_2$, or [$TS_1$ +$TS_2$]=½ inch) I prefer to use 1" deck screws 22, as can be seen in FIG. 3. The shield portions (e.g., $S_1$(1) and $S_2$(1)) are fastened together by running the deck screws 22 from outside to the inside. Preferably, pre-drilled holes are avoided. Use of deck screws 22 is important since they do not require pre-drilled holes, and the threads do not load with lead and tear out as they are run into the lead. Also, the head 24 of deck screws 24 are of a counter sunk type and they will run in flush with the outside or upper surface 26 of the outer layer lead shield portion being assembled. Also, desirable deck screws are provided in hard, brittle materials, which make it easy to break off the threads that protrude through the lead, for example when using one (1) inch screws with a one-half (½) inch total shield thickness. Preferably, the protruding part can be broken off with a hammer or snipped off with pliers, and the lead around the stump 28 can be shaped to assure there are no protruding sharp edges. Likewise, corners C of the shaped lead sheet S are rounded, usually with a hammer, to assure that there are no sharp corners on the finished radiation shield 10.

After the shield portions of the radiation shield 10 are joined, the shield 10 is coated to provide a final cured coating 30. A preferred coating material used to cover the lead and provide a coating 30 is a flexibilized Bisphenol A epoxy which is cross linked with a modified cycloaliphatic amine curing agent. Ideally, such a coatings is provided as a two component, medium viscosity (1250 cps at 77° F.) epoxy, with 100 percent solids. I prefer a product with minimal color fade or degradation upon exposure to sunlight, and with the following performance properties:

(1) Tensile strength, using method ASTM D-538: 1100 pounds per square inch (2) Percent elongation, using method ASTM D-638 60 percent (minimum)

(3) Shore D Hardness, using method ASTM D-2230 37 hardness (4) Tensile Shear Strength, method ASTM D-1002 347 pounds per square inch.

The coating can be applied by roller, paint-brush, or by spray. Particular attention must be paid to the corners C and edges E, to avoid any thin or shallow coated areas. If touch up coats are used or required, they should meet the same coating specifications as the original coating.

Figure 4:
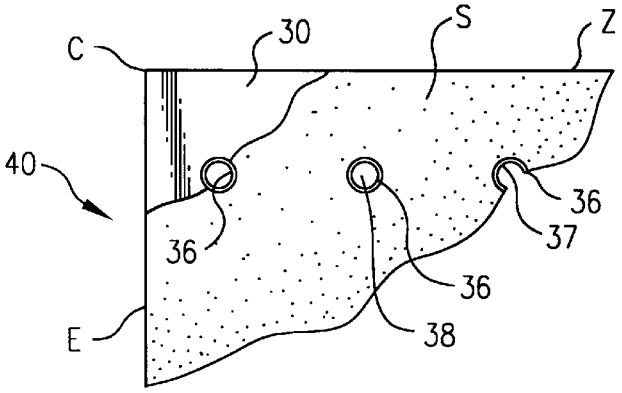
FIG. 4 is a partial cut-away elevational view of a first embodiment of my radiation shield, revealing a resilient exterior coating, showing the underlying lead sheet, as well as passageways through the shields which are defined by grommets.

Once completed, the radiation shield 10 can be placed directly on piping, such as pipe 14, or can also be used as shadow shielding, particularly if it is provided in flat sheet form (as shown as shield 40 in FIG. 4 below) rather than in the shaped shield form just described above. The installation method chosen will also depend upon whether the installation is to be temporary or permanent. For ease of installation, I prefer to use grommets 36 which have in inside wall 37 to define a through passageway 38 in the shield 40. When grommets 36 are used, it is preferable to coat the lead sheet S with coating 30 first, and then install grommet 36. I prefer to grommet shields 40 with grommets 36 on twelve (12) inch centers, starting about six (6) inches from an outer edge E and centered about one and one-half (1 ½) inch from the top Z. Grommets are installed using a five-eighth (⅝) inch hole punch and ideally, five-eighths (⅝) inch brass grommets 36 are utilized. This size allows for some slack when the shield 40 is placed using one-half (½) inch bolts. After installing grommets, if the coating 30 has been damaged, it should be repaired, prior to using the shield 40.

Figure 8:
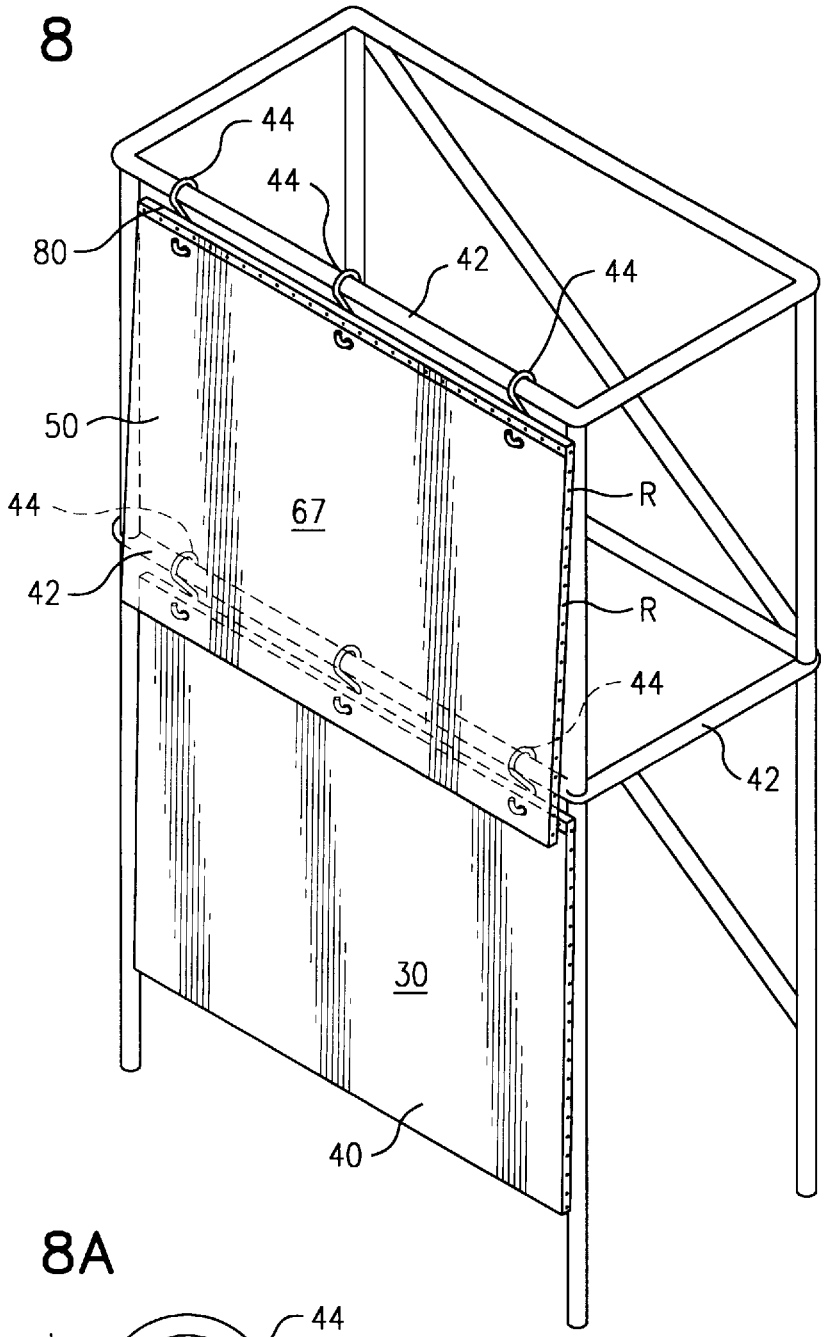
FIG. 8 is a perspective view showing a pair of my stainless steel encapsulated lead type radiation shields in use on a scaffold.
Figure 8A:
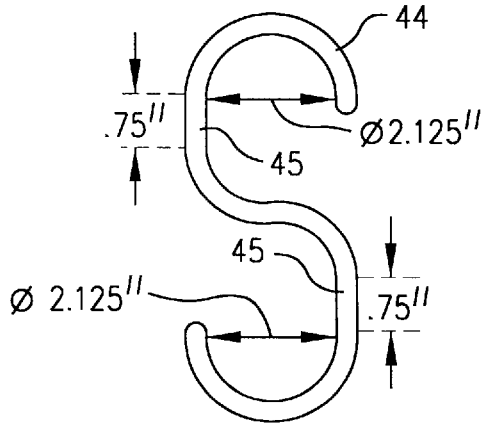
FIG. 8A is a detailed description of one S-hook design for temporary support of my radiation shields.

If sheets 40 of coated lead radiation shield are to be provided as temporary shadow shielding, then the sheets 40 can be supported by scaffold tube framing 42, with the coated lead shield sheets 40 hung on S-hooks 44, as indicated at the bottom of FIG. 8 below. As noted in FIG. 8A, I prefer to make S-hooks 44 from about a 5/16 inch round stock, with about a 2 ⅛ inch diameter in each arm of the S-hook 44, and an extension arm 45 to each end of the S-hook 44 of about three quarters (¾) of an inch.

Figure 12:
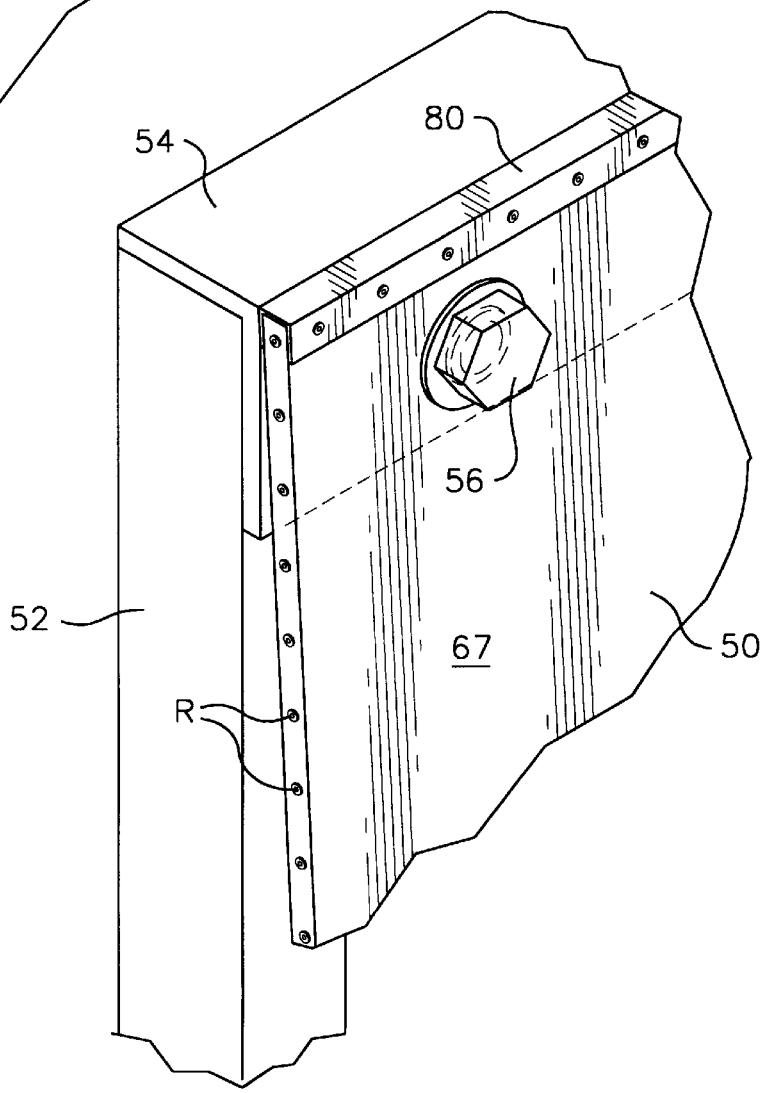
FIG. 12 is a partial perspective view, showing the stainless steel encapsulated lead type radiation shield, as just set forth in FIG. 11 above, now shown in place, secured by bolting to a piece of angle iron.

If the coated lead sheet 40 is used for temporary pipe shielding, then half-rounds can be supported from pipe 14 by wire ties, instead of bands 12 shown above in FIG. 1. However, if the installation is for permanent shadow shielding, then support will be analogous to that shown for a stainless steel encapsulated shield 50 as shown in FIG. 12 below. Specifically, a structural steel support 52 is used to hold an attachment structural steel member 54, to which the shield (such as 40 instead of 50) can be affixed via fastener such as bolt 56 and nut (not shown). Alternately, a shield 40 can be permanently affixed on scaffold tube support frame with wire ties approved for use in the service environment.

I prefer to use a a lead sheet S sized 23.5 inches by 47.5 inches, for the normally encountered radiation shielding situations. Such size sheets S are also advantageous for manufacture of full size twenty four (24) inch by forty eight (48) inch radiation shields 50 which are encapsulated with stainless steel 60. By using the suggested lead sheet S size, space is allowed for covering the lead sheet S and riveting the stainless steel 60, so that the completed panel dimensions are not greater than twenty four (24) inches by forty eight (48) inches.

Figure 6:
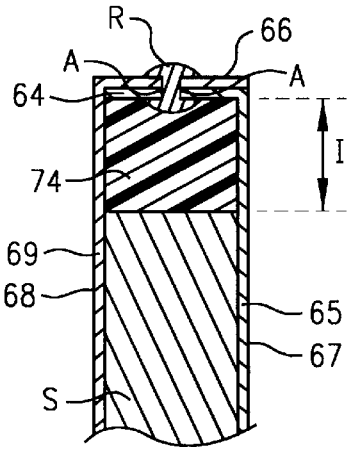
FIG. 6 is a vertical cross sectional view, illustrating one fabrication technique used in fabricating my stainless steel encapsulated lead sheet radiation shield.
Figure 5:
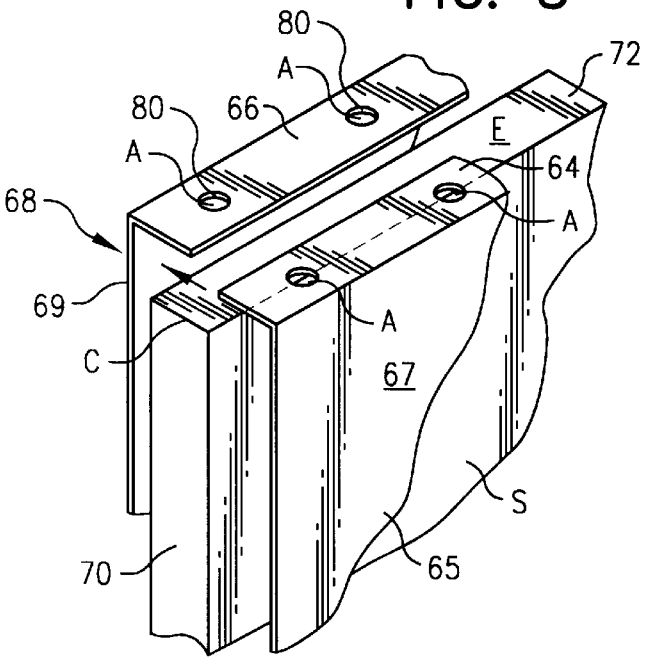
FIG. 5 is a perspective view, showing a second embodiment of my radiation shields, illustrating the first step in the fabrication of a version of my stainless steel encapsulated lead sheet radiation shield.
Figure 7:
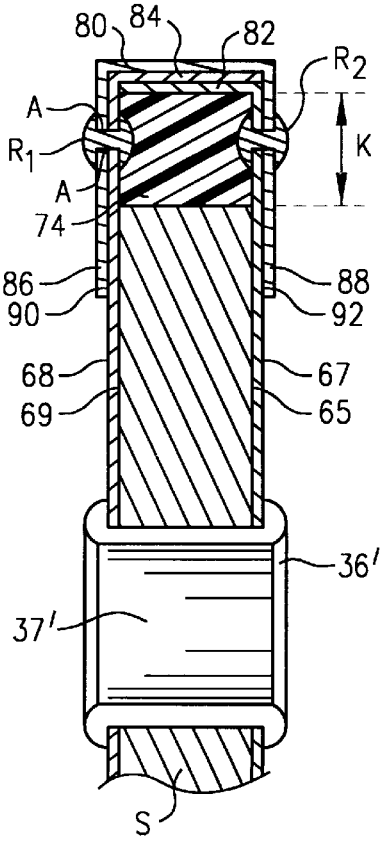
FIG. 7 is a vertical cross sectional view, similar to the view just set forth in FIG. 6, now illustrating another fabrication technique used for providing my stainless steel encapsulated lead sheet radiation shield.

Turning now to FIGS. 5, 6, and 7, one convenient method for manufacture of my stainless steel encapsulated lead shields is shown. Typically, I find that a 20 gauge stainless steel sheet 60 is adequate to provide the encapsulation that my radiation shields 50 require. First, an inner layer of at least one sheet S of solid radiation shielding material, preferably lead, is provided, cut to desired size as described herein. Then, a first, obverse stainless steel panel 62 is cut to a desired size. In FIG. 5, taken looking down at the left side flange 64 on the obverse side 65, shows how flange 64 preferably extends from the face 67 of obverse side 65 at at about a ninety (90) degree angle therefrom. A companion left side flange 66 extends also at preferably about a ninety (90) degree angle from the face 68 of the reverse side 69. This FIG. 5, in combination with FIG. 6, shows the method which is used for encasing the the right and left sides of a radiation shield 50 which has a stainless steel outer casing 60. Bottom 70 of the radiation shielding material S is at the left of FIG. 5. Left edge 72 the radiation shielding material S is at the top of FIG. 5. Preferably matching size apertures A defined by edge portions 80 are located in flanges 64 and 66 are provided for use in securing fasteners R thereto. Note that flanges 64 and 66 extend above edge 72 of the radiation shielding material by a distance I, to leave a void of width I, which void is filled with a suitable sealant 74. I prefer to use silicon caulking or adhesive, but in some applications, a polyvinylchloride type filler will also be acceptable. Preferably after filling the void with sealer 74, flanges 64 and 66 are joined with a mechanical fastener, typically pop type rivets R. I like to use rivets R on one inch centers along the edge of the radiation shield. In any event, sufficient space must be provided, i.e., width I, for the rivets R or other fastening device to be finally assembled without intruding into the at least one sheet S of solid radiation shielding material. Similar construction is typically used for both sides, and generally is also desirable along the bottom of shield, where an obverse bottom flange and a reverse bottom flange are joined in similar fashion.

At the top, in order to provide an extra measure of protection against intrusion of water or steam, a U-shaped cap 80 is preferably provided. Just as with construction of the sides, a void of height K is provided to allow fasteners to join parts without intruding into the at least one sheet S of solid radiation shielding material. The obverse side 65 has a top flange 82, and the reverse side 69 has a top flange 84. Cap 80 in the shape of an elongate, a generally U-shaped channel having a reverse side leg 86 and an obverse side leg 88. The cap 80 is fitted downward over top flange 84 of the reverse side 69, and downward over the top flange 82 of the obverse side 65. The cap 80 is fitted in a manner where an inner portion 90 of the reverse side leg 86 is placed in an abutting relationship with the face 68 of the reverse side 69. Likewise, the cap 80 is fitted in a manner where an inner portion 92 of the obverse side leg 88 is placed in an abutting relationship with the face 67 of the obverse side 65. In this way, a first mechanical fastening device $R_1$ is used to join the reverse side leg 86 of the cap 80 to said reverse side 69. A second mechanical fastening device $R_2$ is used to join the obverse side leg 88 of the cap to the obverse side 65. It is important that the mechanical fastening devices $R_1$ and $R_2$ do not intrude into the at least one sheet S of radiation shielding material. Ideally, the flanges are formed in an integral, one-piece fashion with each of the obverse and reverse panels used to encapsulate the lead sheet used as a core.

As further illustrated in FIG. 7, I prefer to provide a grommet 36' in my radiation shield 50. A plurality of grommets 36' defines through passageways in the radiation shield, so that the radiation shield 50 may be upheld by a supporting structure protruding through said grommet.

Figure 9:
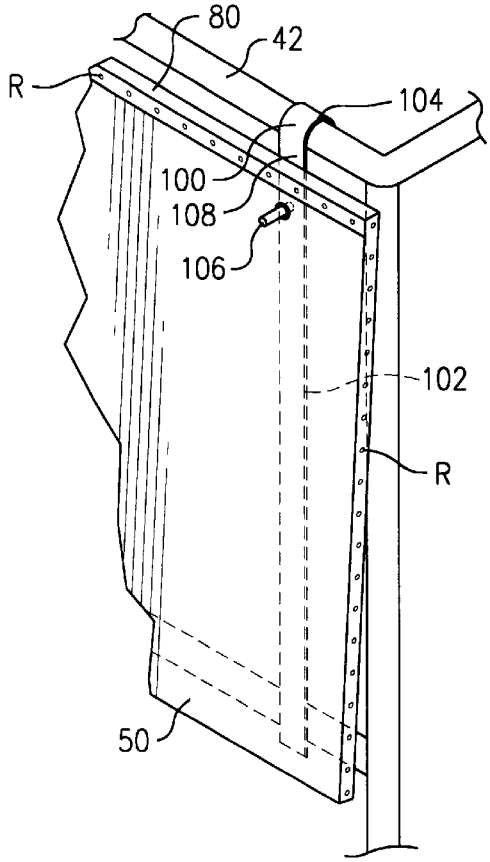
FIG. 9 is a partial perspective view, showing one of my stainless steel encapsulated lead type radiation shields in use on a scaffold, and being hung by my unique radiation shield hanger.
Figure 10:
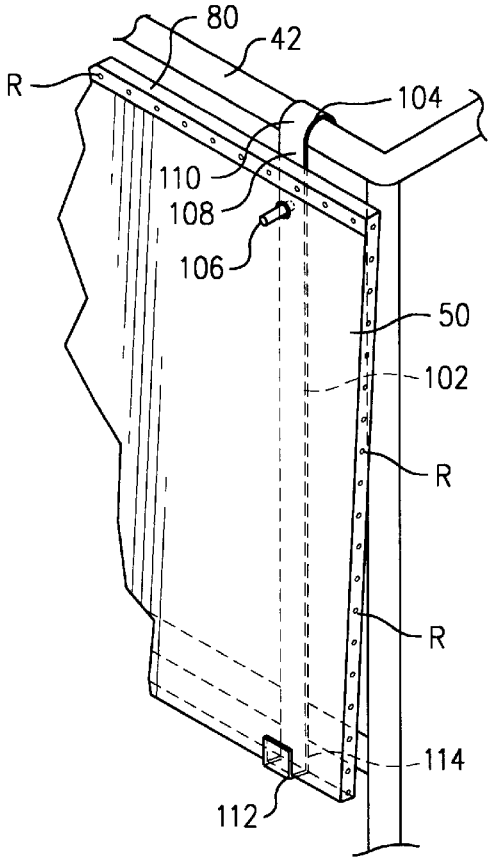
FIG. 10 is a partial perspective view, showing one of my stainless steel encapsulated lead type radiation shields in use on a scaffold, being supported by one type of my unique shield hanger.

An ideal supporting structure is provided by my hangers 100 and 110, as illustrated in FIGS. 9 and 10, respectively. As shown in FIG. 9, hanger 100 includes an elongate, flat bar portion 102, a backwardly curved hook portion 104, and a forwardly protruding stud 106. The stud 106 is attached to the elongate flat bar portion 102 at the upper reaches 108 thereof, and extends forwardly therefrom in a generally horizontal manner, so that the protruding stud 106 extends forward a distance to support, hanging vertically therefrom, a radiation shield 50.

Figure 10A:
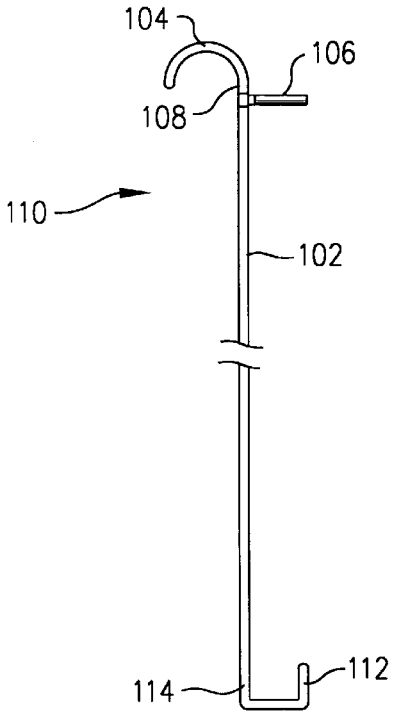
FIG. 10A is a side elevational view of my J-hook type radiation shield hanger.
Figure 11:
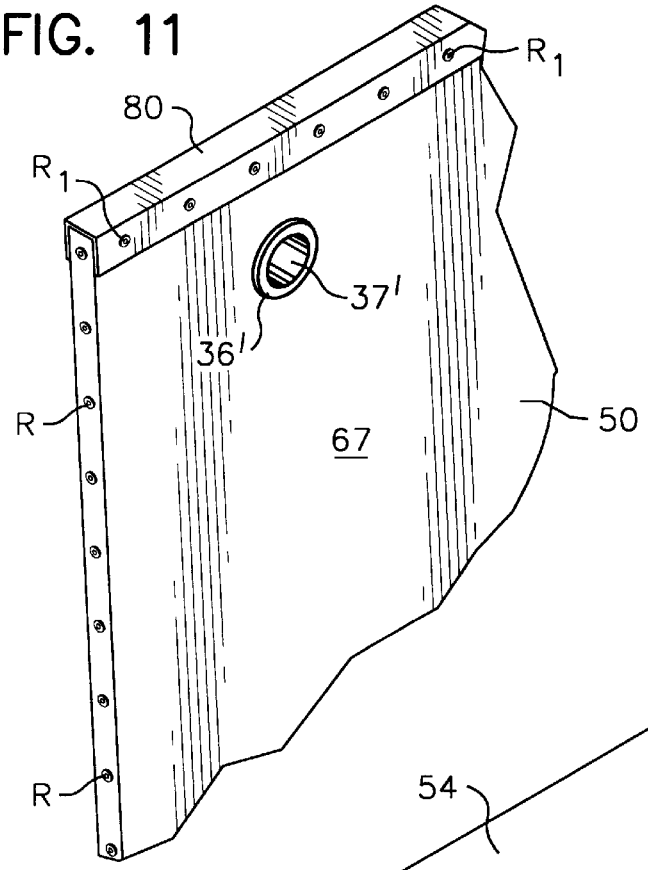
FIG. 11 is a partial perspective view, showing one embodiment of my stainless steel encapsulated lead type radiation shield, with a passageway therethrough defined by a grommet.

As shown in FIG. 10, an alternate hanger 110 is set forth. Hanger 110 is similar to the hanger 100 just described, but further includes a J-shaped hook 112 at the lower reaches 114 thereof. The J-shaped hook 112 is preferably formed as an integral part of the elongate flat bar portion 102, and is provided in sufficient width and shape to cradle therein a planar lower edge 116 of a shield 50 which may require support of stabilization. FIG. 10A shows a side view of the J-hook hanger.

Radiation shields using my design can be custom manufactured to be installed around pipe, conduit, or other structures from which radiation is being emitted. The exact design of the shielding will be based on the radiation source(s), the dose rate both (i) contact and (ii) general area type, the project shielding requirements (whether job specific or area dose rate reduction driven), the area configuration, including environmental conditions, the duration (temporary or permanent), and various engineering requirements, such as structure loading and seismic requirements.

In any event, it will thus be seen that the objects set forth above, including those made apparent from the proceeding description, are efficiently attained, and, since certain changes may be made in carrying out the construction of a radiation shielding apparatus to generally in the manner described, and while still achieving the objectives as set forth herein, it is to be understood that the invention may be embodied in other specific forms without departing from the spirit or essential characteristics thereof. For example, while I have set forth exemplary designs for a stainless steel encapsulated radiation shield design, many other embodiments are also feasible to attain the result of the principles of the apparatus and via use of the methods disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed. On the contrary, the intention is to cover all modifications, equivalents, and alternatives falling within the spirit and scope of the invention as expressed in the appended claims. As such, the claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

What is claimed is:

1. A layered radiation shield, said layered radiation shield comprising:

(a) an inner layer comprising at least one flexible sheet of solid radiation shielding material; and (b) an outer layer comprising a flexible, cohesive elastomeric coating, said elastomeric coating flexibly coating said inner layer, and resistant to discoloration and coating degradation when said layer is exposed to sunlight.

2. The radiation shield as set forth in claim 1, wherein said elastomeric coating has a minimum percent elongation, as measured by ASTM Method D-838, of sixty percent.

3. The radiation shield as set forth in claim 1, wherein said elastomeric coating has a Shore D hardness, as measured by ASTM Method D-2240, of 37.

4. The radiation shield as set forth in claim 1, wherein said elastomeric coating has a tensile shear strength, as measured by ASTM Method D-1002, of approximately 347 pounds per square inch.

5. The radiation shield as set forth in claim 1, wherein said elastomeric coating comprises a Bisphenol A epoxy coating.

6. The radiation shield as set forth in claim 5, wherein said elastomeric coating is cross-linked with a modified cycloaliphatic amine curing agent.

7. The radiation shield as set forth in claim 1, wherein said radiation shield is of the type designed to be held up by a supporting structure, and wherein said radiation shield further comprises at least one grommet, said at least one grommet defining through passageways in said radiation shield, whereby said radiation shield may be upheld by a supporting structure protruding through said grommet.

8. The radiation shield as set forth in claim 1, wherein each of said at least one flexible solid sheets of radiation shielding material is provided in substantially planar form.

9. The radiation shield as set forth in claim 1, wherein each of said at least one solid sheets of radiation shielding material is provided in the shape of a segmented annulus.

10. A method for radiation shielding, said method comprising supporting the radiation shields as set forth in claim 1 between (a) a radiation source, and (b) an area in which a radiation exposure is to be attenuated.

11. The method as set forth in claim 10, wherein said radiation shields are supported by S-hook type fasteners.

12. The method as set forth in claim 10, wherein said radiation shields are supported by J-hook type fasteners.

13. A radiation shield, said radiation shield comprising:

(a) a sequence of layers of radiation shield portions, said sequence of layers of said radiation shield portions comprising a first shield layer $S_1$ through an Nth shield layer $S_N$, wherein N is a positive integral number corresponding to the number of radiation shield layers provided; and wherein in each of said layers $S_1$, through $S_N$, one or more shield portions is provided and wherein the number of shield portions in each of said sequence of layers may be described, in sequence, as shield portions $S_N(1)$ through $S_N(X)$, wherein X is a positive integer corresponding to the number of radiation shield portions in any layer N; and (b) an elastomeric outer coating layer, said elastomeric coating outer layer comprising a flexible, elastomeric coating, said elastomeric coating being resistant to discoloration and coating degradation when said layer is exposed to sunlight.

14. The radiation shield as set forth in claim 13, wherein the number of radiation shield portions X in any one of said sequence of layers N equals the number of radiation shield portions X in an adjacent layer N−1 therebelow.

15. The radiation shield as set forth in claim 14, wherein the number of layers N is equal to two.

16. The radiation shield as set forth in claim 14, wherein said radiation shield further comprises a plurality of mechanical fasteners, and wherein said plurality of mechanical fasteners are adapted to fasten radiation shield portions in said layer $S_N$ to said radiation shield portions in layer $S_{N-1}$.

17. The radiation shield as set forth in claim 16, wherein said mechanical fasteners comprise deck screws.

18. A lightweight, portable radiation shield, said lightweight, portable radiation shield comprising:

(a) an inner layer comprising at least one sheet of solid radiation shielding material;

(b) an outer stainless steel casing;

(c) a sealant, said sealant sealing located between at least portions of said at least one sheet of solid radiation shielding material and said outer stainless steel casing;

(d) said sealant and said stainless steel casing cooperating to effectively seal said solid radiation shielding material against leakage outward through said outer stainless steel casing.

19. The radiation shield as set forth in claim 18, wherein said outer stainless steel casing comprises an obverse side comprising (i) a face, and (ii) a left flange, and a reverse side comprising (i) a face, (ii) a left flange, and wherein said left flange of said obverse side, and said left flange of said reverse side each are sized to extend outward from said at least one sheet of solid radiation shielding material by a clearance distance sufficient to allow said left flange of said obverse side and said left flange of said reverse side to be joined by an internally protruding mechanical fastening device, without said internally protruding mechanical fastening device intruding into said at least one sheet of radiation shielding material.

20. The radiation shield as set forth in claim 19, wherein said stainless steel casing further comprises (a) a right flange on said obverse side, and (b) a right flange on said reverse side, (c) and wherein said right flange of said obverse side and said right flange of said reverse side each are sized to extend outward from said at least one sheet of solid radiation shielding material by a clearance distance sufficient to allow said right flange of said obverse side and said left flange of said reverse side to be joined by an internally protruding mechanical fastening device, without said internally protruding mechanical fastening device intruding into said at least one sheet of radiation shielding material.

21. The radiation shield as set forth in claim 19, wherein said stainless steel casing further comprises (a) a bottom flange on said obverse side, and (b) a bottom flange on said reverse side, (c) and wherein said bottom flange of said obverse side and said bottom flange of said reverse side each are sized to extend downward below the bottom of said at least one sheet of radiation shielding material by a clearance distance sufficient to allow said bottom flange of said obverse side and said bottom flange of said reverse side to be joined by an internally protruding mechanical fastening device, without said internally protruding mechanical fastening device intruding into said at least one sheet of radiation shielding material.

22. The radiation shield as set forth in claim 19, wherein said stainless steel casing further comprises (a) a top flange on said obverse side, and (b) a top flange on said reverse side, (c) and wherein said top flange of said obverse side and said top flange of said reverse side each are sized to extend upward above the top of said at least one sheet of radiation shielding material by a clearance distance sufficient to allow said top flange of said obverse side and said top flange of said reverse side to be joined by an internally protruding mechanical fastening device, without said internally protruding mechanical fastening device intruding into said at least one sheet of radiation shielding material.

23. The radiation shield as set forth in claim 22, further comprising a stainless steel cap, said stainless steel cap comprising an elongate, generally U-shaped channel having a reverse side leg and an obverse side leg, said cap fitted downward over said top flange of said reverse side and said top flange of said obverse side in a manner where said reverse side leg is placed in an abutting relationship with said reverse side, and wherein said obverse side leg is placed in an abutting relationship with said obverse side leg, and wherein a first mechanical fastening device is used to join said reverse side leg of said cap to said reverse side, and a second mechanical fastening device is used to join said obverse side leg of said cap to said obverse side, and wherein each of said first and said second mechanical fastening devices do not intrude into said at least one sheet of radiation shielding material.

24. The radiation shield as set forth in claim 23, wherein each of said first and said second mechanical fastening devices comprises pop-type rivets.

25. The radiation shield as set forth in claim 23, wherein said radiation shield is of the type designed to be held up by a supporting structure, and wherein said radiation shield further comprises at least one grommet, said at least one grommet defining through passageways in said radiation shield, whereby said radiation shield may be upheld by a supporting structure protruding through said grommet.

26. The radiation shield as set forth in claim 18, wherein said sealant comprises a silicon caulking compound.

27. The radiation shield as set forth in claim 18, wherein said sealant comprises polyvinyl chloride filler.

28. The combination of a radiation shield and a hanger, said combination comprising:

(a) a radiation shield, said shield comprising a body with opposing substantially planar surface portions, and, through said body, at least one through passageway having edge portions, said at least one through passageway in said radiation shield structurally adapted to allow said radiation shield to be held by a supporting structure protruding at least partially into said through passageway; and (b) a hanger, said hanger comprising (1) an elongate, flat bar portion;

(2) a backwardly curved hook portion;

(3) a forwardly protruding stud, (A)said forwardly protruding stud attached to said elongate flat bar portion at the upper reaches thereof and extending forwardly therefrom in a generally horizontal manner, (B) said forwardly protruding stud extending forward a sufficient distance to support, hanging vertically therefrom, a radiation shield.

29. The combination as set forth in claim 28, further comprising a J-shaped hook, said J-shaped hook located at the lower reaches of said elongate, flat bar, said J-shaped hook adapted to cradle therein said edge portion of said through passageway of said radiation shield.

30. A method for radiation shielding, said method comprising:

(a) supporting radiation shields between an ionizing radiation source, and (b) an area in which exposure to said ionizing radiation is be attenuated, wherein said radiation shields comprise (i) an inner layer comprising at least one sheet of solid radiation shielding material;

(ii) an outer stainless steel casing;

(iii) a sealant, said sealant located between at least portions of said at least one sheet of solid radiation shielding material and said outer stainless steel casing;

(iv) said sealant and said stainless steel casing cooperating to effectively seal said solid radiation shielding material against leakage outward through said outer stainless steel casing.

* * * * *